US007070017B2

(12) United States Patent
Hoshi et al.

(10) Patent No.: US 7,070,017 B2
(45) Date of Patent: Jul. 4, 2006

(54) ROTATING APPARATUS FOR CONSTRUCTION MACHINE

(75) Inventors: Akio Hoshi, Ibaraki (JP); Kazuhisa Tamura, Ibaraki (JP); Nozomu Tanaka, Ibaraki (JP); Shuuji Tabata, Ibaraki (JP); Koji Kawasaki, Ibaraki (JP); Yukio Yanagisawa, Ibaraki (JP)

(73) Assignee: Hitachi Construction Machinery Co., LTD, Tokyo (JP)

( * ) Notice: Subject to any disclaimer, the term of this patent is extended or adjusted under 35 U.S.C. 154(b) by 15 days.

(21) Appl. No.: 10/506,972

(22) PCT Filed: Oct. 10, 2003

(86) PCT No.: PCT/JP03/13056

§ 371 (c)(1),
(2), (4) Date: Sep. 8, 2004

(87) PCT Pub. No.: WO2004/033805

PCT Pub. Date: Apr. 22, 2004

(65) Prior Publication Data

US 2005/0253339 A1 Nov. 17, 2005

(30) Foreign Application Priority Data

Oct. 11, 2002 (JP) ..... 2002-298331

(51) Int. Cl.
*F16J 15/32* (2006.01)
*E02F 9/12* (2006.01)

(52) U.S. Cl. ..... 180/89.13; 277/563; 277/572; 277/551

(58) Field of Classification Search ..... 277/551, 277/563, 572; 296/190.05; 180/89.13
See application file for complete search history.

(56) References Cited

U.S. PATENT DOCUMENTS

| | | | | | |
|---|---|---|---|---|---|
| 2,189,686 | A | * | 2/1940 | Stevenson | 384/150 |
| 3,418,937 | A | * | 12/1968 | Cardillo et al. | 417/270 |
| 3,595,586 | A | * | 7/1971 | Anderson | 277/353 |
| 3,612,546 | A | * | 10/1971 | Otto | 277/565 |
| 3,625,526 | A | * | 12/1971 | McCormick | 277/445 |
| 3,659,910 | A | * | 5/1972 | Foster | 384/119 |
| 3,869,181 | A | * | 3/1975 | Barber | 384/482 |
| 4,005,769 | A | * | 2/1977 | Itoh | 188/315 |
| 4,188,038 | A | * | 2/1980 | Goedicke | 277/622 |
| 4,413,829 | A | * | 11/1983 | Pietsch | 277/504 |
| 4,759,265 | A | * | 7/1988 | Stoll et al. | 92/153 |
| 5,016,721 | A | * | 5/1991 | Yamamoto et al. | 180/89.13 |
| 5,161,580 | A | * | 11/1992 | Klug | 138/92 |
| 5,209,499 | A | * | 5/1993 | Ruff et al. | 277/551 |
| 5,209,502 | A | * | 5/1993 | Savoia | 277/562 |
| 5,228,842 | A | * | 7/1993 | Guebeli et al. | 417/360 |

(Continued)

FOREIGN PATENT DOCUMENTS

| | | | |
|---|---|---|---|
| JP | 645961 S | * | 1/1989 |
| JP | 2001115487 A | * | 5/2001 |

*Primary Examiner*—Patricia L. Engle
*Assistant Examiner*—Jonathan Liu
(74) *Attorney, Agent, or Firm*—Maier & Maier, PLLC

(57) ABSTRACT

A swing mechanism for a construction machine having a grease bath seal. A grease bath can be disposed on a vehicular base carrier of the machine, and can be coupled with a swing frame. The grease bath seal can then act to prevent intrusion of pollutants or other foreign materials into the grease bath. The seal may act to prevent intrusion of pollutants or other foreign materials over an extended amount of time and can be arranged in such as manner as to improve the durability and tightness of a seal member.

12 Claims, 6 Drawing Sheets

U.S. PATENT DOCUMENTS 5,435,697 A * 7/1995 Guebeli et al. ..... 417/53
5,722,664 A * 3/1998 Otto ..... 277/559
5,944,321 A * 8/1999 Niebling et al. ..... 277/549
6,170,588 B1 * 1/2001 Irino et al. ..... 180/89.1
6,203,022 B1 * 3/2001 Struschka et al. ..... 277/572
6,220,600 B1 * 4/2001 Tripathy et al. ..... 277/309
6,302,402 B1 * 10/2001 Rynders et al. ..... 277/530
6,511,108 B1 * 1/2003 Roessner et al. ..... 292/320
6,615,942 B1 * 9/2003 Shinohara et al. ..... 180/69.21
2005/0183824 A1 * 8/2005 Lee et al. ..... 156/345.31
2005/0215330 A1 * 9/2005 Foster-Hamilton et al. . 464/175
2005/0239554 A1 * 10/2005 Wang ..... 464/17

* cited by examiner

ROTATING APPARATUS FOR CONSTRUCTION MACHINE

BACKGROUND

1. Field of the Invention

This invention relates to a grease bath seal for use with a grease bath of a swing mechanism of a construction machine, for example, a swing mechanism on a hydraulic power shovel or excavator or a swing mechanism on a hydraulic crane.

2. Discussion of the Background

Generally speaking, construction machines like hydraulic power shovels or excavators have an excavating or other working mechanism mounted on an upper swing structure which is rotatably mounted on a vehicular base carrier. Through a swing mechanism, the upper swing structure is rotatably supported on the vehicular base carrier. The swing mechanism is largely constituted by an outer ring which is mounted on a swing frame of the upper swing structure, an inner ring which is mounted on a top frame plate on the side of the vehicular base carrier, and bearings interposed between the outer and inner rings. A swinging pinion which is rotationally driven from a hydraulic motor is meshed with a ring gear which is formed on and around the inner periphery of the inner ring. A grease bath in the form of an annular groove is provided on the side of the vehicular base carrier for pooling grease to be used as a lubricant for meshed sliding portions of the ring gear and the swinging pinion. On the inner peripheral side, the annular groove of the grease bath is bounded by a tubular wall. Upper end portions of this tubular wall have to be kept out of contact with the swing frame of the upper swing structure. Therefore, the upper end of the tubular wall in the inner side of the grease bath is usually left in an open state despite intrusion of water, mud, dirt or other pollutants through upper open portions. Intrusion of such pollutants accelerate deteriorations of grease to invite low lubricity of meshed portions of the ring gear and swinging pinion, resulting in development of rust in a worse case.

In solving the problem just mentioned, it has been known in the art to provide a seal member on a tubular wall at the inner periphery of a grease bath for the purpose of preventing intrusion of pollutants into the grease bath, as described in Japanese Laid-Open Utility Model Application S64-5961. This prior art seal member is arranged to be gripped on the tubular wall in a fixed state, with its fore end portion held in sliding contact with a swing frame.

In this connection, from the standpoint of economical use of grease, it is desirable that the grease bath has the minimum necessary capacity in volume, that is to say, it is desirable that the grease bath has a width slightly larger than the outside diameter of the swinging pinion. For this purpose, it becomes necessary to mount a seal member on a tubular wall of a larger diameter. As a result, the circumferential speed in swinging motions of the upper swing structure is increased to accelerate abrasive wear of the seal member. Therefore, the seal member prematurely loses its sealing power. In addition, when the upper swing structure and the vehicular base carrier are moved in upward and downward directions, respectively, under the influence of vibrations which are generated by a machine operation, the seal member is set apart from the frame of the upper swing structure, opening up a gap space which would permit intrusion of pollutants into the grease bath. Furthermore, at the time of replacing a seal member which no longer has a sufficient sealing power, it has been necessitated to separate the upper swing structure from the vehicular base carrier. That is to say, troublesome heavy jobs have been required for replacement of a seal member.

SUMMARY

In view of the foregoing situations, it is an object of the present invention to provide a grease bath seal for a swing mechanism of a construction machine, which can prevent intrusion of pollutants or other foreign material into a grease bath over an extended period of time in a reliable manner.

It is another object of the present invention to provide a grease bath seal of the sort as mentioned above, which is arranged in such a manner as to improve the durability and tightness of a seal member.

It is still another object of the present invention to provide a grease bath seal of the sort as mentioned above, which can maintain a function of lubricating meshed portions of a swinging pinion and a ring gear over an extended period of time.

It is a further object of the present invention to provide a grease bath of the sort as mentioned above, which is arranged particularly to facilitate replacement of a seal member of the grease bath of the swing mechanism.

In order to achieve the foregoing objectives, according to the present invention, there is provided a grease bath seal for a swing mechanism of a construction machine, having an inner ring on the side of a vehicular base carrier of the machine relatively rotatably coupled with an outer ring on a swing frame on the side of an upper swing structure of the construction machine, a ring gear provided at and around the inner periphery of the inner ring and meshed with a swing pinion on the side of the upper swing structure, a center joint located within an opening provided in the swing frame at a rotational center thereof, and a grease bath located beneath the swing frame and around the center joint and defining an annular grease bath portion around a top plateau wall connected to the center joint, thereby to lubricate meshed portions of the ring gear and the swing pinion, characterized in that the grease bath seal comprises: an annular seal member having a height larger than a width of a spacing between the swing frame of the upper swing structure and the top plateau wall of the grease bath in a free state and interposed in a compressed state between the top plateau wall and the swing frame at a position radially outward of the center joint; and the seal member being detachably fixed either on the side of the swing frame or on the side of the top plateau wall of the grease bath, and having an annular sliding portion extended out in a radially inward direction from the other side for pressed sliding contact with the top plateau wall or the swing frame.

The grease bath serves to pool a lubricant, typically grease. However, a lubricant of any other kind can be stored in the grease bath as long as it is suited for lubricating meshed portions of the swinging pinion and the ring gear. The top plateau wall, which is connected to the center joint, is extended radially inward from other bath-forming walls. In this instance, the top plateau wall may be formed integrally with bath-forming walls as one integral structure. Any way, the top plateau wall is located almost entirely in face to face relation with the swing frame of the upper swing structure. Accordingly, a seal member can be located at any arbitrary radial position between the swing frame and the top plateau wall of the grease bath. However, it is desirable to locate the seal member in the proximity of the center joint which is at the center of swing motions of the upper swing structure.

The seal member is fixed on one of the top plateau wall of the grease bath and the swing frame, and held in sliding contact with the other one. The seal member may be formed in a square, rectangular or circular shape in section, and anchored either on the side of the top plateau wall or on the side of the swing frame, preferably on the upper side of the top plateau wall of the grease bath. More specifically, in a preferred form of the present invention, the seal member is constituted by an annular main block having an anchoring end portion and a lipped end portion on the outer and inner peripheral sides thereof. An annular lip portion is erected at and along the inner periphery of the lipped end portion. A sliding end portion is provided at the top of the lip portion.

In order to detachably fix the seal member in a sealing position on the grease bath, a seal holder in the form of a staggered ring is fixed on the top plateau wall of the grease bath. The staggered ring has a base portion and a holder portion on the outer and inner peripheral sides thereof. The base portion is fixed on the top plateau wall, and the holder portion is raised from the surface of the top plateau wall to form an annular open seal socket on the inner peripheral side. The anchoring end portion on the outer peripheral side of the main block of the seal member is fixedly gripped in a compressed state between the annular holder portion of the seal holder and the top plateau wall. Therefore, when the seal member is worn out, it can be easily removed and replaced by a fresh one since the inner peripheral side of the top plateau wall is opened up in a readily accessible state upon dismantling the center joint from an opening at the center of the swing frame.

The annular lip portion of the seal member is projected upward from the lipped end portion of the main block, preferably at the inner periphery of the lipped end portion. Preferably, the lip portion is inclined radially inward so that its fore end portion is bent inward toward the center of swing motion through elastic deformation as soon as it is abutted against the lower side of the swing frame, and kept in sliding contact with the latter over a predetermined width in the radial direction to lessen the degree of its abrasive wear. Namely, when the seal member is set in position, the lip portion is brought into a flexed state against the lower side of the swing frame. As a result, even if the vehicular base carrier and the upper swing structure of the machine are moved in different directions to widen the spacing between the top plateau wall of the grease bath and the swing frame under the influence of vibrations which are generated during a machine operation, such movements of the vehicular base carrier and upper swing structure can be absorbed by elastic deformation of the lip portion of the seal member, without allowing a gap space to be opened up between the lip portion and the swing frame. Further, as the seal member is set in position with the lip portion resiliently deformed in a radially inward direction, seal member seals the grease bath more tightly, pushing back pollutants or contaminants which tend to get into the grease bath from between its lip portion and the swing frame Furthermore, a lubricant like grease which gets between the seal member and the swing frame can act to suppress abrasive wear of the lip portion which is in sliding contact with the lower side of the swing frame. For this purpose, a lubricant reservoir groove is formed on the lipped end portion of the seal member radially on the outer side of the lip portion to pool the same lubricant as the one in the grease bath. In order to store a predetermined amount of lubricant in the lubricant reservoir groove, it is desirable to form an annular reservoir groove on the top side of the lipped end portion of the seal member or to form an annular reservoir groove between the lip portion and an annular projection which is formed at and around the outer periphery of the lipped end portion radially at a space from the lip portion. In a case where an annular projection is formed at the outer periphery of the lipped end portion of the seal member, it may be arranged to stand short of and out of contact with the lower side of the swing frame but it is preferred to form the annular projection in a greater height to bring an upper end portion of the annular projection into sliding contact with the lower side of the swing frame for the purpose of preventing overflowing of the lubricant. In this regard, the annular projection may be extended in the same direction as the lip portion, but it is preferred to make arrangements let upper end portions of the annular projection undergo elastic deformation in the opposite direction relative to elastic deformation of the lip portion.

The opening which is provided in the top plateau wall for mounting a center joint is relatively narrow in diameter. Therefore, in order to facilitate replacements of the seal member furthermore, the top plateau wall of the grease bath may be constituted by two separable parts, i.e., an outer plateau wall section which is formed integrally with other bath-forming walls, and an inner plateau wall section which is connected with the center joint. In a case where the outer periphery of the inner plateau wall section is joined with the inner periphery of the outer plateau wall section, it is desirable to locate the seal member across joined ends of the inner and outer plateau walls, sealing the joint portion with the main block body of the seal member.

DETAILED DESCRIPTION

Figure 1:
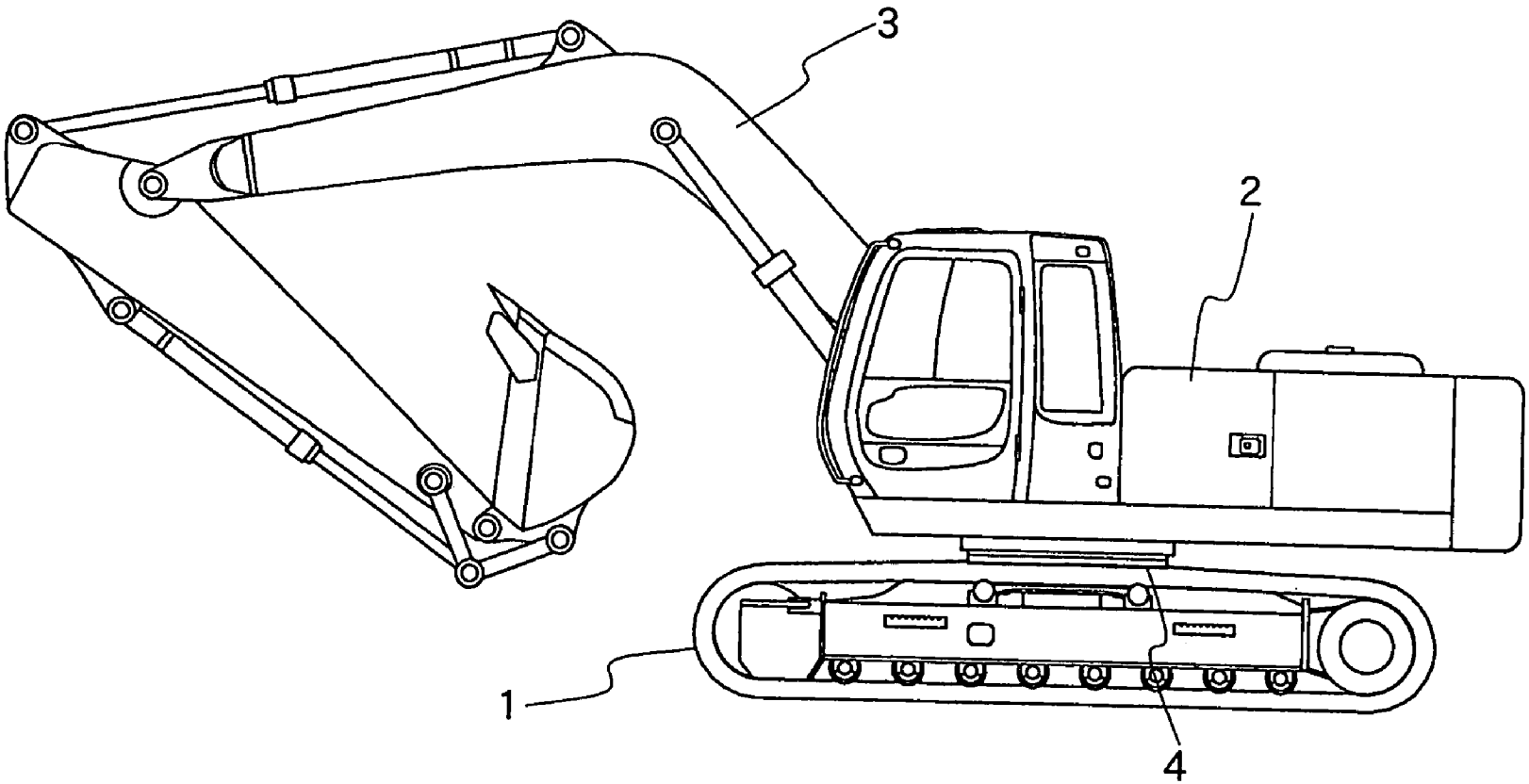
FIG. 1 is a schematic outer view of a hydraulic power shovel, shown as a typical example of construction machines in general.

Hereafter, the present invention is described more particularly by way of its preferred embodiments with reference to the accompanying drawings. Referring first to FIG. 1, there is shown a hydraulic power shovel or excavator as an example of construction machine having a working mechanism including an excavation means on an upper swing structure which is rotatably mounted on a vehicular base carrier.

In the drawing, indicated at 1 is the vehicular base carrier with a pair of crawler type drive means. An upper swing structure 2 is rotatably mounted on top of the vehicular base carrier 1, and a front working mechanism 3 with an earth excavating means is provided on the upper swing structure 2. The upper swing structure 2 is connected with the vehicular base carrier 1 through a swing mechanism 4 to permit swing motions of the upper swing structure 2 relative to the vehicular base carrier 1.

Figure 2:
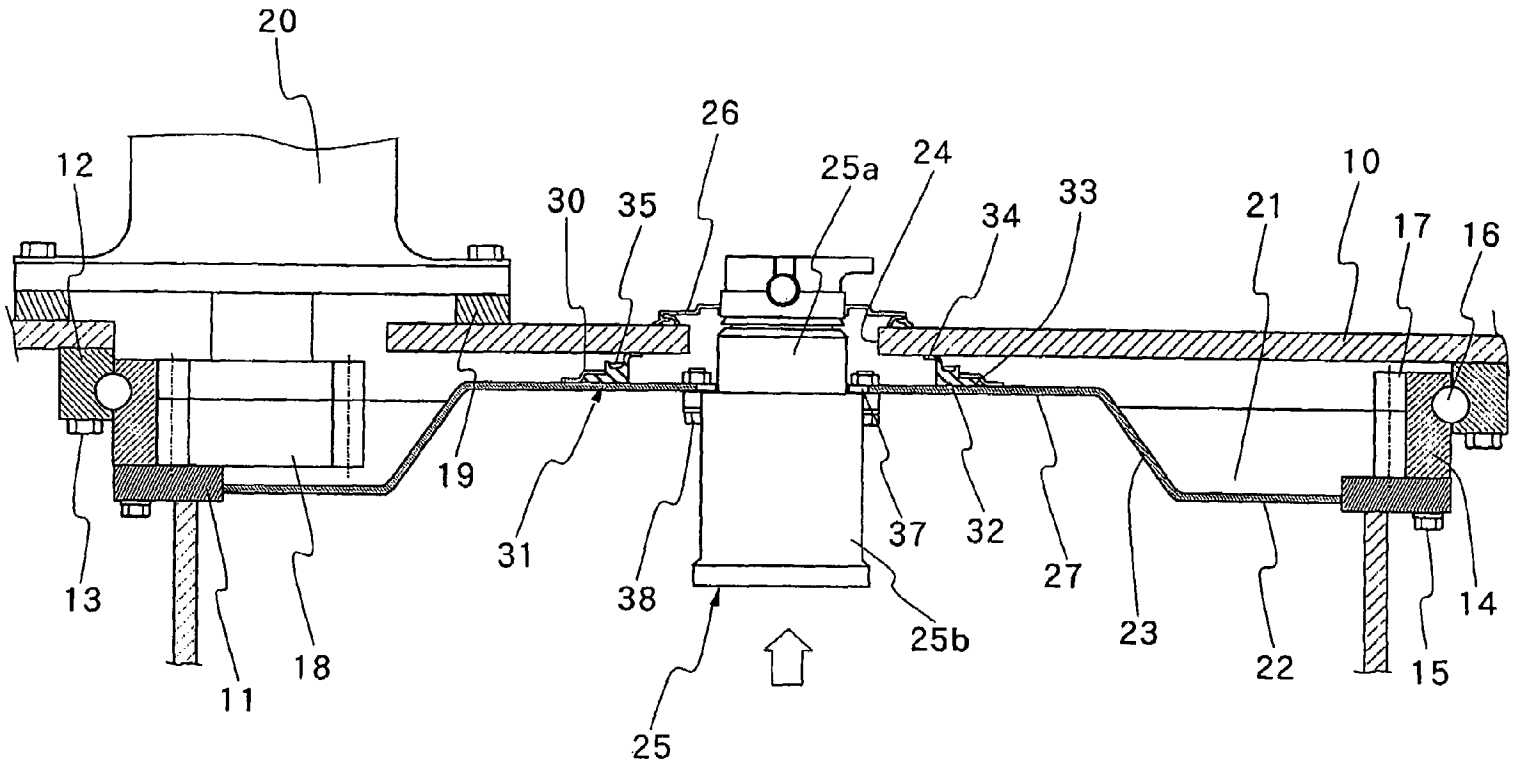
FIG. 2 is a schematic sectional view of a swing mechanism incorporating a grease bath seal according to a first embodiment of the present invention.

Shown in FIG. 2 is the construction of the swing mechanism 4. In that figure, indicated at 10 is a swing frame of the upper swing structure 2, and at 11 a frame plate on the side of the vehicular base carrier 1. An outer ring 12 is securely fixed to the swing frame 10 by means of bolts 13, while an inner ring 14 is securely fixed to the top frame plate 11 by means of bolts 15. These outer and inner rings 12 and 14 are relatively rotatably coupled with each other through swing bearings 16.

In order to turn the swing frame 10, a swinging pinion 18 is meshed with a ring gear 17 which is formed on and around the inner periphery of the inner ring 14. The swinging pinion 18 is rotationally driven from a swing drive motor 20 which is mounted on top of a base 19. A grease bath 21 is provided for the purpose of lubricating meshed portions of the pinion 18 and the inner ring 14. This grease bath 21 is securely fixed to the frame top plate 11 by welding or other suitable fixation means, and arranged to define an annular bath of a predetermined depth by way of bath-forming walls, i.e., a sunken bottom wall 22 and an inner sloped or wall rising obliquely toward an upper connecting portion 27 from the bottom wall 22. As a lubricant, a suitable amount of grease is pooled in the grease bath 21. In the case of the particular embodiment shown, the grease bath 21 is formed in an annular shape and, in order to minimize the amount of grease to be pooled, it is arranged to have a minimum necessary width which is determined in relation with the outside diameter of the pinion 18.

A center joint 25 is placed in an opening 24 which is provided at the center of rotation of the swing frame 10. The center joint 25 serves to make connections of pipes which supply pressure oil to and from the drive motor of the vehicular base carrier 1. Lower part 25B of the center joint 25 is fixed on the vehicular base carrier 1 and relatively rotatably coupled with an upper part 25A. Boot rubber 26 is fitted around the upper part 25A of the center joint in such a way as to shield the opening 24. This boot rubber 26 may be omitted in a case where the opening 24 is completely sealed by means of a seal member 31 which will be described hereinlater. The lower part 25*b* of the center joint 25 is connected to the inner end of a top plateau wall 27 of the grease bath, which is extended horizontally inward from upper end of the sloped or inclined wall 23.

Figure 3:
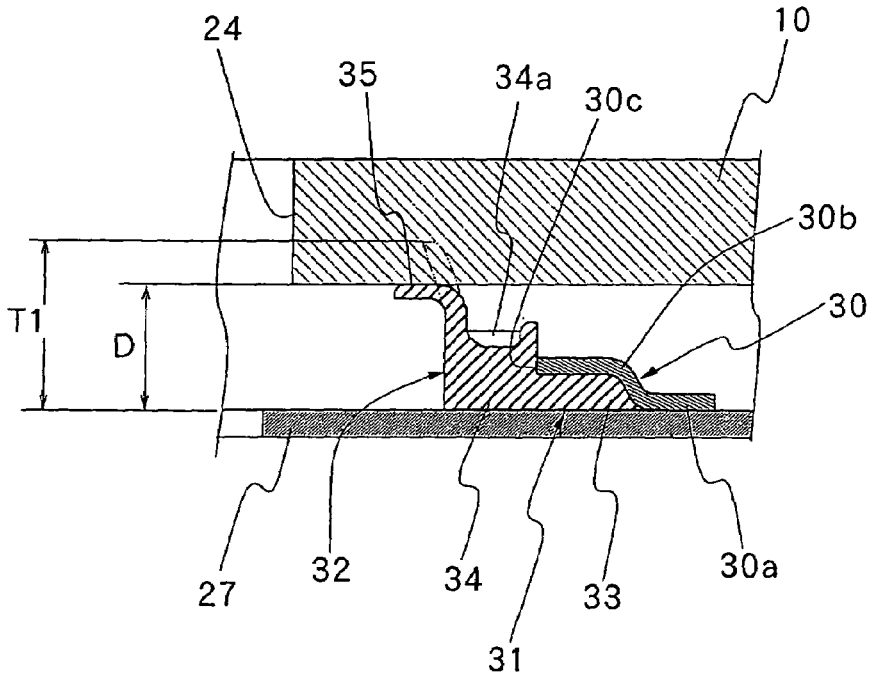
FIG. 3 is a fragmentary sectional view, showing the grease bath seal of FIG. 2 on an enlarged scale.

Namely, in the enlarged view of FIG. 3, indicated at 30 is a seal holder and at 31 a seal member 31. The seal holder 30 is in the form of a staggered metal ring which is formed by bending an annular metal strip at a radially halfway position into a staggered shape having a base portion 30*a*, which is securely fixed on the upper side of the top plateau wall 27, a riser wall portion 30*b* which rises in a radially outward direction by a predetermined distance from the base portion 30*a*, and an annular holder wall portion 39*c* which extends radially inward from the riser wall portion 30*b* substantially in parallel relation with the top plateau wall 27. The seal holder 30 is arranged to accommodate the seal member 31 between the annular gripping wall portion 30*c* and the riser wall portion 30*b*. Namely, the seal member 31 is removably and fixedly gripped in position by the annular gripping wall portion 30*c* and the riser wall portion 30*b* of the seal holder member 30. On the other hand, the seal member 31 is formed of resilient material like rubber, and provided with a main seal block 32 in the form of an annular block having substantially a rectangular shape in section. More specifically, the main seal block 32 of the seal member 31 is composed of an anchoring end portion 33 and a lipped end portion which is formed integrally with the anchoring end portion 33 radially on the inner side of the latter. The lipped end portion 34 is thicker than the anchoring end portion 33 and thus stepped up from the latter. A lip 35 is extended radially outward from at the inner periphery of the lipped end portion 34.

The seal member 31 which is retained in position by the seal holder 30 functions to prevent dirt, soil or other contaminants from entering the grease bath 21 through the opening 24 which is formed in the swing frame 10 for mounting the center joint 25. Outer peripheral edges of the fixed base end portion 30*a* of the seal holder 30 are located radially inward of the upper end of the inclined wall 23 which is connected to the top plateau wall 27. The diameter at the fore distal end of the lip portion 35 of the seal member 31 is larger than the diameter of the opening 24. Namely, the seal member 31 is interposed between the central plateau wall portion 27 and the swing frame 10 at a position which is as close as possible to the opening 24.

The annular gripping wall portion 30*c* of the seal holder member 30 is provided at a lower level than the top surface of the anchoring end portion 33 of the seal member 31. Therefore, along with the anchoring end portion 33, the main ring block 32 is retained substantially in a compressed state and intimately pressed against the top plateau wall 27 of the grease bath. Preferably, in a free state, the main ring block 32 of the seal member 31 is arranged to have an outside diameter slightly larger than an inside diameter at the outer end of the riser wall portion 30*b* of the seal holder 30. As a consequence, the seal member 31 is biased in radially outward directions, and, once fitted in the seal holder 30, it is retained in position in a stabilized state. In other words, the anchoring end portion 33 of the seal member 30 is held in tight and intimate contact with the upper side of the top plateau wall 27 and the seal holder 30 to form a tight seal therebetween.

The lip portion 35 which is erected at the inner periphery of the lipped end portion 34 may be extended straight in a radially outward direction. However, it is more preferable to incline the lip portion 36 toward the center of rotation of the swing frame 10 as indicated by imaginary line in FIG. 3. Further, in a free state, the height T1 of the lip portion 35 on the top plateau wall 27 is larger than the width D of the spacing between the top plateau wall 27 and the swing frame 10. Accordingly, the lip portion 35 is held in contact with the lower side of the swing frame 10 over a surface area of a predetermined width. The width of the spacing between the swing frame 10 and the top plateau wall 27 of the grease bath is varied by operational vibrations of the construction machine. However, as long as such vibrations are smaller than the dimensional difference between the height T1 of the seal portion 35 and the width D of the spacing between the top plateau wall 27 and the swing frame 10, the seal member 31 functions to maintain the tightness of its seal, that is to say, the lip portion 35 is held tightly against the swing frame 10 and prevented from getting out of contact with the swing frame 10. In a case where the lip portion 35 is inclined in a radially inward direction as described above, it can be bent readily in a radially inward direction as soon as it is abutted against the lower side of the swing frame 10.

The lip portion 35 is erected at or in the close proximity of the inner periphery of the lipped end portion 34 which has a predetermined width in the radial direction between the lip portion 35 and the anchoring end portion 33. An annular groove 34*a* is formed on the upper side of the lipped end portion 34 to serve as a reservoir of a lubricant. In this instance, grease is pooled in the lubricant reservoir groove 34*a* thereby to lubricate sliding surfaces on the lower side of the swing frame 10 and on the lip portion 35.

Between the swing frame 10 and the top plateau wall 27, the seal member 31 is not necessarily required to produce sealing effects in those areas which are located radially inward of its own position. However, if a large amount of contaminants enters the opening 24 from the side of the upper swing structure 2, it may impose adverse effects on coupled portions of the upper and lower parts 25*a* and 25*b* of the center joint 25. This is the reason why the boot rubber 26 is fitted between the upper part 25*a* of the center joint 25 and the top side of the swing frame 10. Nevertheless, the provision of the boot rubber 26 is not a paramount requisite.

Figure 4:
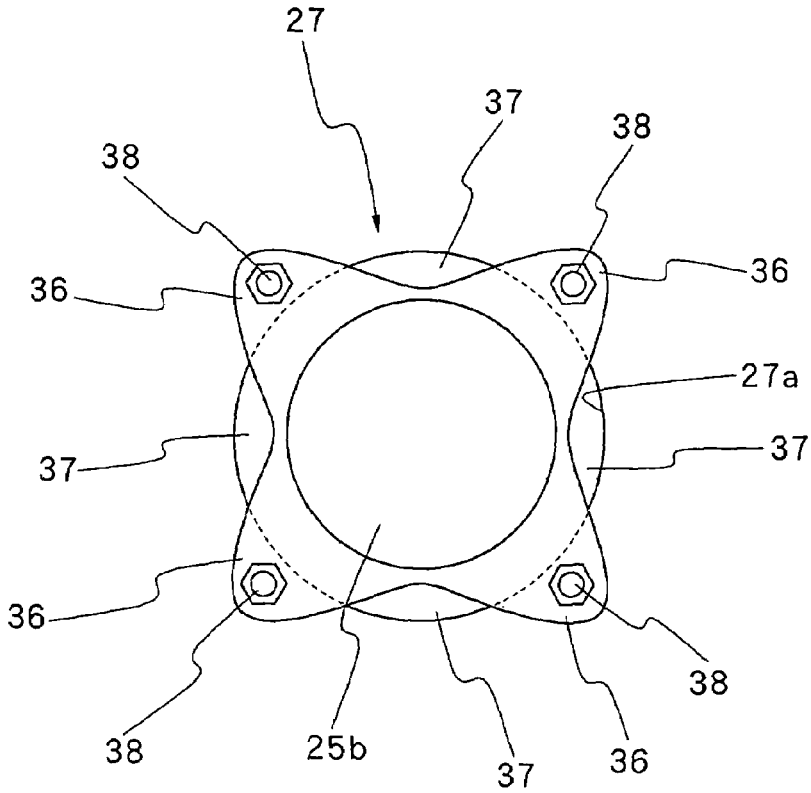
FIG. 4 is a schematic view of a center joint in FIG. 2, taken from the direction indicated by an arrow.

Further, if contaminants enter the opening 24 through the boot rubber 26 and deposit on and around the lower part 25*b* of the center joint 25, they may give rise to rust or deterioration of the seal member 31. For the purpose of precluding such troubles, the upper and lower parts 25*a* and 25*b* of the center joint 25 are coupled with each other in the manner as shown in FIG. 4. Namely, in order to pass the center joint 25, the top plateau wall 27 is provided with a through hole 27*a* which is larger than the outside diameter of the lower part 25*b* of the center joint 25, and a plural number of radial connecting projections 36 (four radial connecting projections 36 in the case of the particular embodiment shown) are provided at angular intervals around the lower part 25*b* of the center joint 25. The radial projections 36 are connected to the top plateau wall 27 by the use of bolts 38. Spacings 37 are provided between the top plateau wall 27 and the radial projections 36, so that contaminants getting around the center joint 25 can be quickly and smoothly discharged through the spacings 37 instead of lingering on or around the center joint 25.

With the above-described construction, the grease bath 21 is securely shielded off from the outside to prevent intrusion of water, dirt, soil or other foreign material which would contaminate grease or lubricant, accelerating abrasive wear of meshed portions of the ring gear 17 and the revolving pinion 18 which are constantly supplied with a lubricant from the grease bath 21.

More specifically, since the anchoring end portion 33 of the seal member 31 is constantly pressed downward by the seal holder 30, the seal member 31 is prevented from falling down even though the lip portion 35 is abutted against the lower side of the swing frame 10 at a position radially inward of the main seal block 32. Besides, since the seal member 31 is held in a compressed state, it is tightly held in contact with the top plateau wall 27 over the entire surfaces from the main seal block 32 to the anchoring end portion 33. In addition, the lip portion 35 is arranged to have a predetermined extra length so that the extra length portion is pressed against and held in surface contact with the lower side of the swing frame 10. Accordingly, there is no possibility of the lip portion 35 being set apart from the swing frame 10 even if water and mud happen to act on the seal member 31 under high pressure. That is to say, an extremely stable seal is formed by the seal member 31.

When the upper swing structure 2 is turned, the lip portion 35 of the seal member 31 is caused to slide along the swing frame 10. The seal member 31, particularly the lip portion 35 of the seal member 31 is located closely to the center of rotation of the swing frame 10. Therefore, the radius of rotation of the lip portion 35, about the center of rotation of the swing frame 10, is very small, so that its abrasive wear can be suppressed to a minimum. In addition, abrasive wear is suppressed furthermore by supply of grease to sliding portions of the lip portion 35 and the swing frame 10 from the lubricant reservoir groove 34*a* which is provided on the main seal block 34.

Since the lip portion 35 is pressed against the swing frame 10, its sealing function will drop due to abrasive wear over a long period of time. In such a case, it becomes necessary to replace the seal member 31. At the time of replacement of the seal member 31, the center joint 25 is disassembled and a new seal member 31 is placed in position through the opening 24 of the swing frame 10. Since the seal member 31 is made of resilient material and only slightly larger than the opening 24 in diameter, it can be easily deformed in a diametrical direction into a smaller size suitable for passing through the swing frame 10. The seal member 31 tends to restore its original size in diameter as soon as it is placed in position on the top plateau wall 27. Then, the seal member 31 is pushed to slide in a radially outward direction along the top plateau wall 27 until the anchoring end portion 33 is accommodated to a predetermined extent in and by the seal holder 30. Thus, the seal member 31 can be replaced in an extremely facilitated manner.

Figure 5:
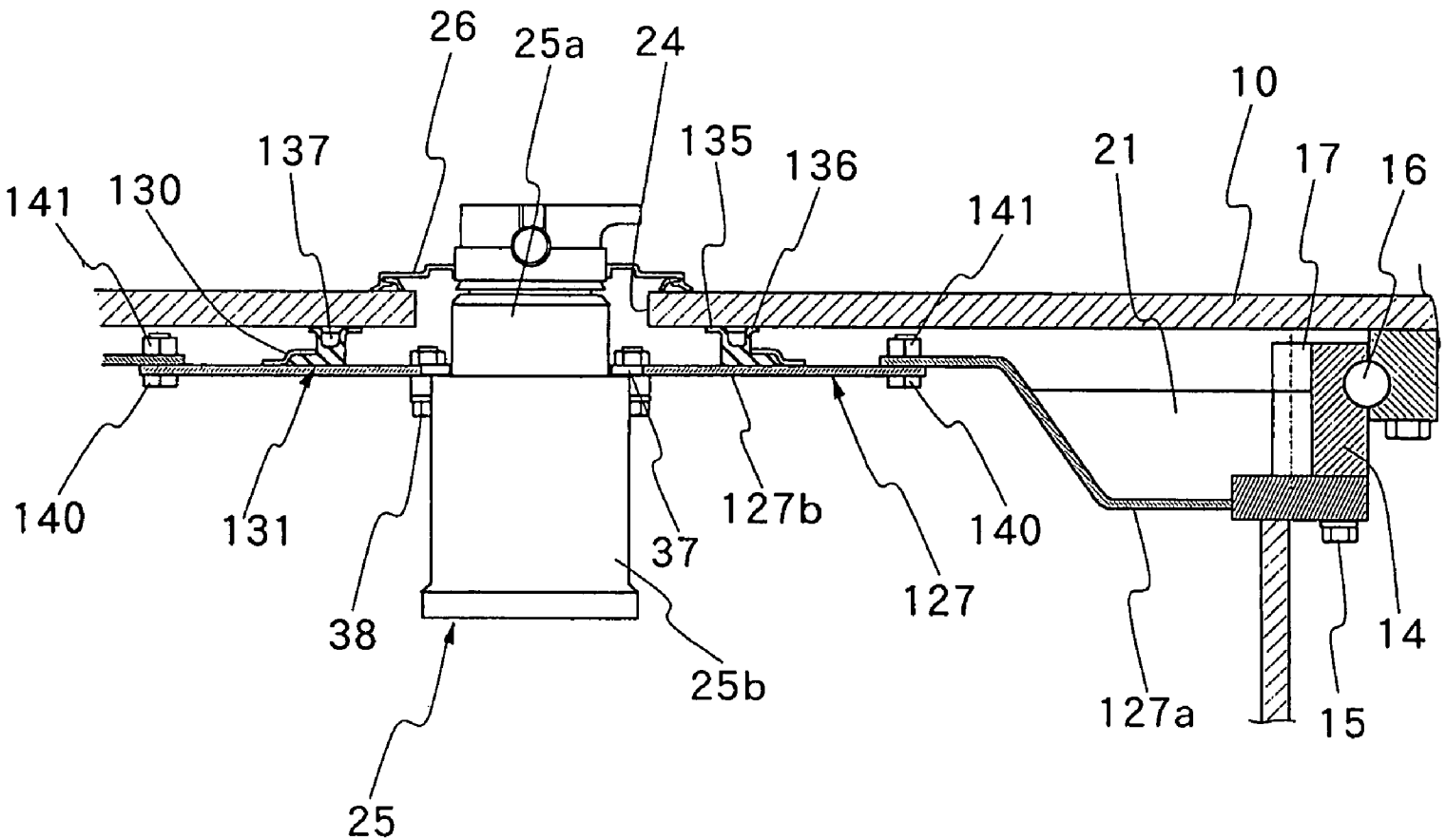
FIG. 5 is a schematic sectional view of a swing mechanism incorporating a grease bath seal adopted as a second embodiment of the present invention.
Figure 6:
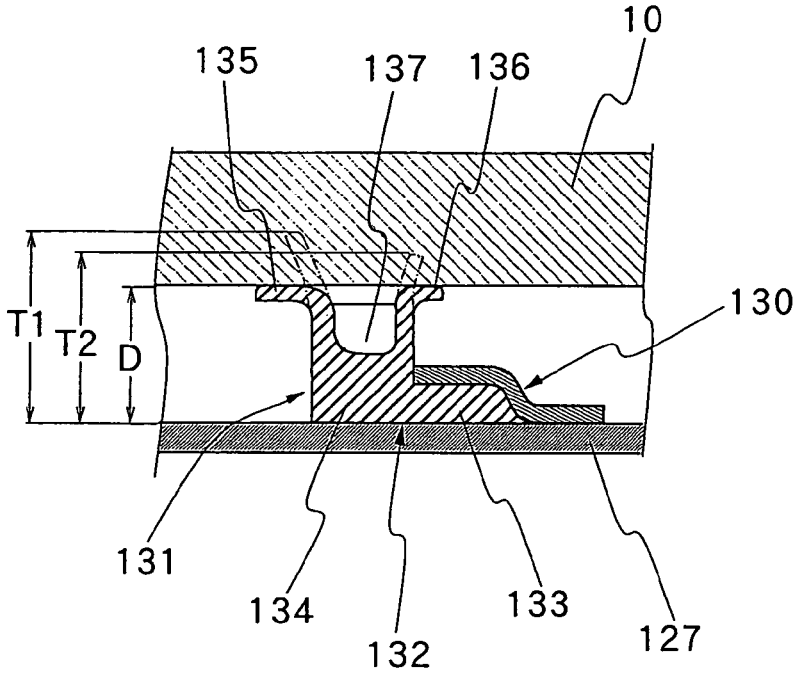
FIG. 6 is a fragmentary sectional view showing the grease bath seal of FIG. 5 on an enlarged scale.

Turning now to FIGS. 5 and 6, there is shown a second embodiment of the present invention. In the case of this second embodiment, a main seal block 132 of a seal member 131 is composed of an anchoring end portion 133 and a lipped end portion 134. A lip portion 135 is erected at the inner periphery of the lipped end portion 134. This lip portion 135 is inclined in a radially inward direction by a predetermined inclination angle. In these respects, the seal member 131 has no differences from the counterpart in the foregoing first embodiment. In the present embodiment, the seal member 131 is provided with an annular projection 136 on its outer peripheral side, in such a way as to define an annular lubricant reservoir groove 137 between the lip portion 136 and the annular projection 136 for storing therein a lubricant like grease.

In this instance, the annular projection 136 is not necessarily required to have such a height which is sufficient for abutting engagement with the lower side of the swing frame 10. However, in order to prevent grease from flowing out of the annular storage groove 137, it is preferred that the upper end of annular projection 136 be kept in abutting engagement with the lower side of the swing frame 10 as shown in FIG. 6. More preferably, the seal member 131 is arranged such the annular projection 136 has a height H2 from the bottom side of the seal member 131, which is larger than the width D of the spacing between the top plateau wall 127 and the swing frame 10, and the annular projection 136 is inclined in a direction away from the lip portion 135 or inclined to the outer peripheral side by a predetermined inclination angle. When arranged in such a way, there is no possibility of a gap space opening up on the lower side of the swing frame 10 and the upper end of the annular projection 136 as a result of abrasive wear caused by swing motions of the upper swing structure 2. However, the height T2 of the annular projection 136 may be shorter than the height 1 of the lip portion 135.

Figure 7:
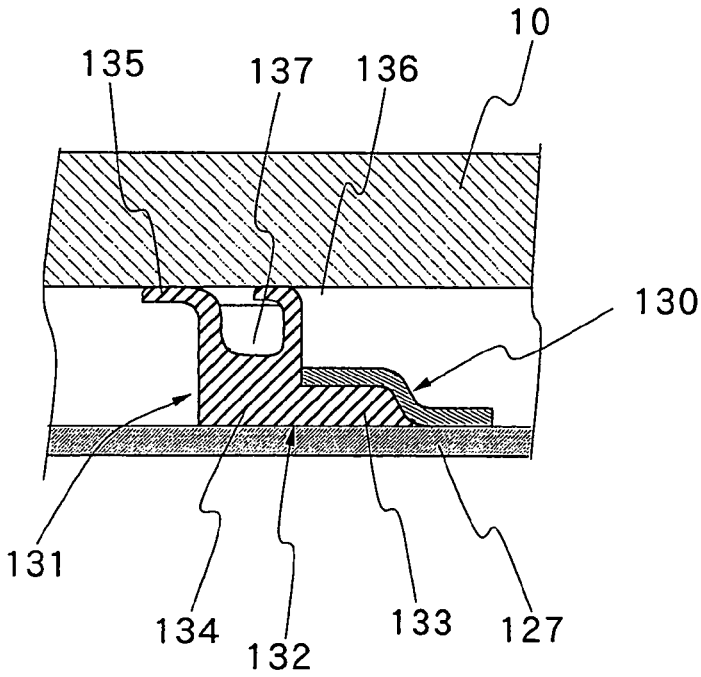
FIG. 7 is a fragmentary sectional view showing on an enlarged scale the seal member of FIG. 5 which has been set in position by the same method as in the first embodiment.

In the same manner as in the foregoing first embodiment, the seal member 131 can be assembled with the seal holder 130 on the top plateau wall 127. More specifically, upon fitting the anchoring end portion 133 of the seal member 131 into the seal holder 130 on the top plateau wall 127 from inner side, the annular projection 136 is flexed in the same direction as the lip portion 135 as shown in FIG. 7. As a result, the grease reservoir groove 137 is deformed to some extent, but the deformation would not give rise to any problem in particular as long as a grease reservoir space exists within the groove 137.

However, in case it is desired to store a greater amount of grease in the annular storage groove 137, the upper end of the annular projection 136 may be flexibly bent in a radially outward direction away from the lip portion 135 as shown in FIG. 6. Further, in order to facilitate mounting of the seal member 131 itself, it is desirable to make arrangements as follows. Namely, to permit facilitated mounting of the seal member 131, the top plateau wall 127 is composed of two separably connected parts as shown in FIG. 5, i.e., an outer plateau wall section 127*a* which is provided integrally with the bottom and sloped walls of the grease bath in the foregoing first embodiment, and an inner plateau wall section 127*b* which is connected to the center joint 25. In this case, the seal holder 130 is provided on the part of the inner plateau section 127*b*.

The outer and inner plateau wall sections 127*a* and 127*b* are connected to each other by means of bolts 140 at a position radially on the outer side of the seal holder 130, with connecting end portions of the outer and inner plateau wall sections 127*a* and 127*b* overlapped one on the other over a predetermined length. In this instance, nuts 141 are fixedly provided on the top side of the outer plateau wall section 127*a* by welding or other fixation means. Besides, although not shown in the drawings, a seal member is interposed between overlapped end portions of the outer and inner plateau wall sections 127*a* and 127*b*.

With the arrangements just described, after removing the inner plateau wall section 127*b* along with the center joint 25, the seal member 131 is set in the seal holder 130 which is fixed on the inner plateau wall section 127*b*, and grease is filled in the lubricant reservoir groove 137. Then, an outer end portion of the inner plateau wall section 127*b* is abutted against the outer plateau wall section 127*a* from beneath and connected to the latter by tightening the bolts140 into the nuts 141. Whereupon, the lip portion 135 and the annular projection 136 of the seal member 131 are caused to flex in radially inward and outward directions, respectively, permitting to store a larger amount of grease therebetween. In this case, since the seal member 131 can be set in position on the inner plateau wall section 127*b* which is in a totally exposed state, it can be quite easily set in the seal holder 130 because the seal member 131 is subjected to compressive deformation in a less degree.

Figure 8:
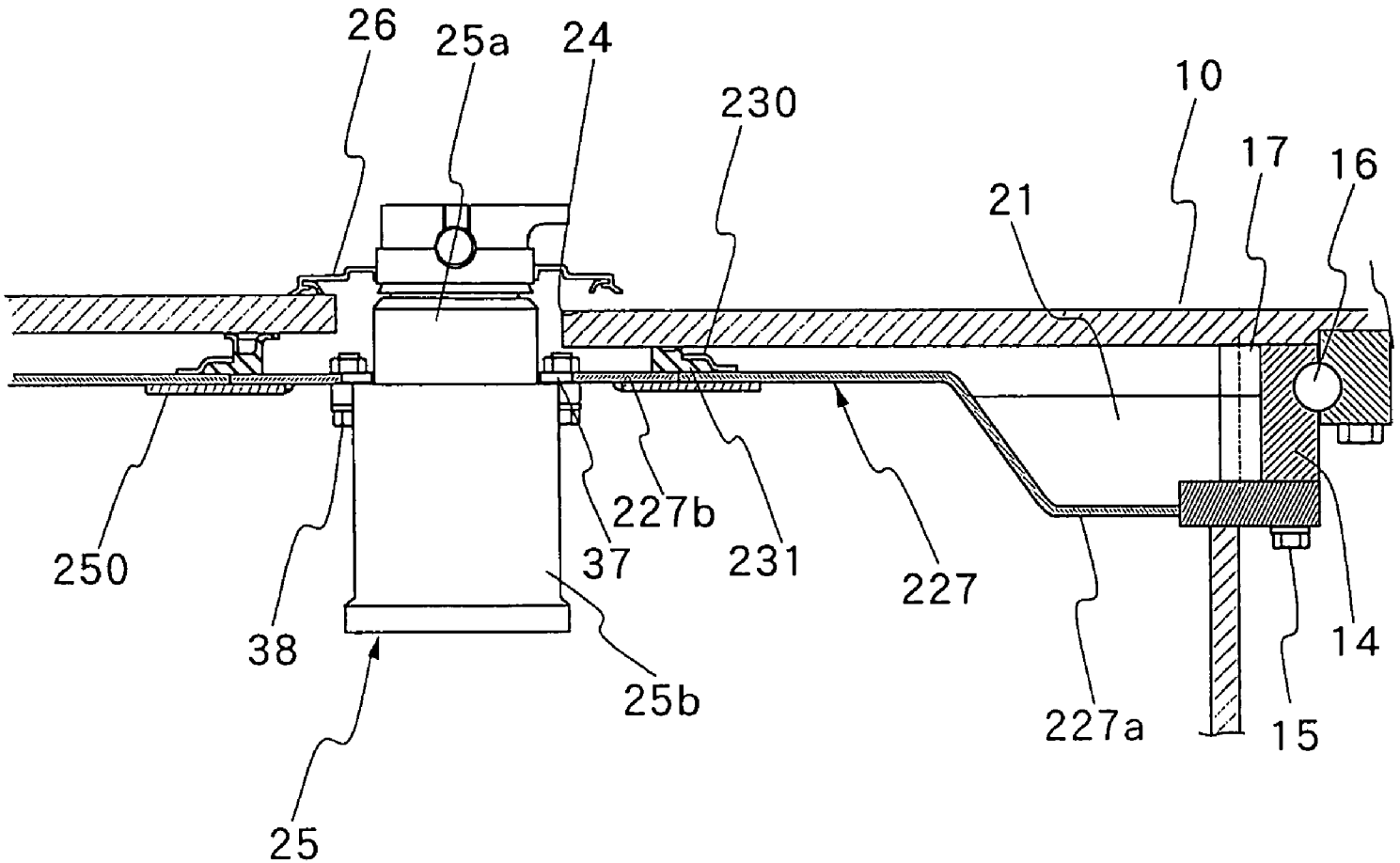
FIG. 8 is a fragmentary sectional view showing another example of separable plateau wall arrangement in the second embodiment of the present invention.

Further, shown in FIG. 8 is another modification in which a seal holder 230 is mounted on an outer plateau wall section 227*a* which is arranged to integrally include the respective bath-forming walls of the grease bath 21, and joined at its inner periphery end with an inner plateau wall section 227*b* which is connected to the center joint 25. In this case, for facilitating mounting of the seal member 231 and at the same time for sealing joined end portions with the seal member 231, the outer and inner plateau wall sections 227*a* and 227*b* are arranged to be joined at a position beneath the seal member 231. An annular extension 250 is fixedly welded or bolted to outer peripheral portions of the inner plateau wall section 227*b* and abutted against inner peripheral portions of the outer plateau wall section 227*b* from beneath thereby to support the loads of the outer plateau wall section 227*a*.

Being arranged in the manner as described above, the grease bath seal according to the present invention can prevent foreign matter such as water and mud from getting into a grease bath, preventing deterioration of a lubricant like grease and prolonging its service life in a very reliable manner.

What is claimed is:

1. A swing mechanism of a construction machine, comprising:

an inner ring on the side of a vehicular base carrier relatively rotatably coupled with an outer ring on a swing frame on the side of an upper swing structure of the construction machine, a ring gear provided on the inner periphery of said inner ring and meshed with a swinging pinion on the side of said upper swing structure, a center joint located within an opening provided in said swing frame at a rotational center thereof, and a grease bath located beneath said swing frame and around said center joint and defining an annular grease bath portion around a top plateau wall connected to said center joint, thereby to lubricate meshed portions of said ring gear and said swing pinion, wherein said grease bath seal comprises:

an annular seal member having a height larger than a width of a spacing between said swing frame of said upper swing structure and said top plateau wall of said grease bath in a free state and interposed in a compressed state between said top plateau wall and said swing frame at a position radially outward of said center joint; and said seal member being detachably fixed either on the side of said swing frame or on the side of said top plateau wall of said grease bath, and having an annular sliding portion extended out in a radially inward direction from the other side for pressed sliding contact with said top plateau wall or said swing frame.

2. A swing mechanism of a construction machine as defined in claim 1, wherein said seal member is located at a position in the proximity of said center joint.

3. A swing mechanism of a construction machine as defined in claim 1, wherein said seal member is formed by an annular main block having an anchoring end portion of a length on the outer peripheral side and a lipped end portion on the inner peripheral side thereof, said lipped end portion having an annular lip portion erected at and along inner periphery thereof, and said grease bath seal further comprises a seal holder in the form of a ring of a staggered shape in section having a raised seal holder portion at a height from upper surface of said top plateau wall of said grease bath, and a base portion formed around outer periphery of said seal holder portion and fixed on said top plateau wall at a position in the proximity of said center joint.

4. A swing mechanism of a construction machine as defined in claim 3, wherein said lip portion is projected upward from said lipped end portion of said main block and adapted to be bent downward through upon abutment against lower side of said swing frame through elastic deformation for sliding contact with the latter over a width in radial direction.

5. A swing mechanism of a construction machine as defined in claim 3, wherein said seal member is provided with a lubricant reservoir on said main block radially on the outer side of said lip portion to store the same lubricant as the one in said grease bath.

6. A swing mechanism of a construction machine as defined in claim 5, wherein said lubricant reservoir is in the form of an annular groove formed on the top side of said lipped end portion radially on the outer side of said lip portion to store the same lubricant oil as the one in said grease bath.

7. A swing mechanism of a construction machine as defined in claim 5, wherein said lubricant reservoir is formed by an annular projection provided at and along outer periphery of said lipped end portion of said seal member.

8. A swing mechanism of a construction machine as defined in claim 7, wherein said annular projection is arranged to have a sufficient projection length for sliding contact with lower side of said swing frame.

9. A swing mechanism of a construction machine as defined in claim 8, wherein said annular projection is adapted to bent upon abutment against lower side of said swing frame through elastic deformation in an opposite direction relative to direction of elastic deformation of said lip portion.

10. A swing mechanism of a construction machine as defined in claim 1, wherein said top plateau wall is divided into two separable plateau sections, said two separable plateau sections including an outer plateau wall section formed integrally with other bath-forming walls of said grease bath, and an inner plateau wall section connected to said center joint on the inner peripheral side thereof.

11. A swing mechanism of a construction machine as defined in claim 10, wherein inner and outer peripheral ends of said outer and inner plateau wall sections are joined with each other at a position, and said seal member is located across joined ends of said outer and inner plateau wall sections.

12. A swing mechanism of a construction machine as defined in claim 1, wherein said plateau wall is connected to said center joint in such a way as to leave one or a plural number of gaps or opening around said center joint.

* * * * *